United States Patent [19]

Golben

[11] 4,282,931

[45] Aug. 11, 1981

[54] METAL HYDRIDE ACTUATION DEVICE

[75] Inventor: Peter M. Golben, St. Paul, Minn.

[73] Assignee: The United States of America as represented by the Secretary of the Interior, Washington, D.C.

[21] Appl. No.: 114,522

[22] Filed: Jan. 23, 1980

[51] Int. Cl.[3] ..... A62C 35/02; A62C 37/18; B67B 7/24

[52] U.S. Cl. ..... 169/61; 60/527; 169/9; 169/26; 169/85; 222/83

[58] Field of Search ..... 169/9, 26, 29, 61, 71, 169/85; 239/309; 123/DIG. 12; 222/83, 85; 60/527, 528; 236/4, 18, 32, 42, 63, 99 R

[56] References Cited

U.S. PATENT DOCUMENTS

| | | | |
|---|---|---|---|
| 1,933,694 | 11/1933 | Allen et al. | 169/26 X |
| 2,588,788 | 3/1952 | Zell | 169/26 |
| 3,176,460 | 4/1965 | Lindberg | 60/527 X |
| 3,209,937 | 10/1965 | Hirst et al. | 169/26 X |
| 3,744,816 | 7/1973 | Yamaguchi et al. | 169/28 X |
| 3,776,313 | 12/1973 | DePalma | 169/26 X |
| 3,937,284 | 2/1976 | Young | 169/42 X |
| 4,178,882 | 12/1979 | Anderson et al. | 123/DIG. 12 X |

*Primary Examiner*—Robert J. Spar
*Assistant Examiner*—Fred A. Silverberg
*Attorney, Agent, or Firm*—Thomas Zack; Donald A. Gardiner

[57] ABSTRACT

A self-recocking actuation device. One possible use for it is in conjunction with a pneumatic fire protection system. This invention employs the process known as occlusion to store large amounts of gas in a small volume. Metal hydrides in a chamber are used to store hydrogen in the disclosed preferred embodiment. Upon the application of heat—from a heat source like a resistance heater—the charged metal hydride releases its hydrogen ($H_2$) in a chamber having only one exit opening which empties into a sealed bellows. This bellows contacts a piston located in another chamber wherein a biased resetting spring is provided to normally maintain the piston in contact with the bellows. As the pressure from the $H_2$ gas builds up, it overcomes the biased spring to move it and the piston along with an associated pin or other actuator. If used to actuate a pneumatic fire protection system, the pin or actuator at the downward side of its stroke in turn, may puncture a shearable diaphragm or in some other way releases the contents of a container containing a second gas, like nitrogen ($N_2$), which is then released from a second exit port in a different chamber to charge the fire protection system. Recocking of the piston begins as the heating of the metal hydride ceases. As cooling takes place the hydrogen is absorbed to reenter the hydride to decrease the gas pressure supplied. The piston's biased resetting spring then recocks the piston to its original position.

10 Claims, 4 Drawing Figures

METAL HYDRIDE ACTUATION DEVICE

BACKGROUND OF THE INVENTION

1. Field of the Invention

A metal hydride actuation device having resetting capability.

2. Description of the Prior Art

The prior art teaches it is old to electrically heat an element to ignite an inflammable material, like a nitrocellulose solution in powder form, which then causes a piston to be moved against a biasing spring. A penetrating device may also move with the piston to penetrate a seal or disc for a fire extinguishing agent which is then released. The U.S. Pat. No. 1,933,694 to S. E. Allen et al discloses such a system.

Other exemplary United States patents which disclose actuators for releasing pressure from a vessel include the following: U.S. Pat. Nos. 3,209,937 (R. Hirst et al); 3,744,816 (Yamaguchi et al); and 3,937,284 (R. J. Young). None of these inventions mentioned disclose a metal hydride system for use with a trigger device to provide for both the actuation of the device and its recocking. Thus, this invention provides a safe, reliable, rugged, self-recocking and inexpensive trigger device heretofore unknown in the art.

SUMMARY OF THE INVENTION

This invention is a metal hydride actuation device. Its basic components include: a heat source to supply heat to a chamber containing a metal hydride and the capability of releasing the gas (hydrogen) give off as the hydride is heated; a movable piston against which the gas given off acts; a resetting biasing member (spring) associated with the piston to normally maintain it in one position; an actuator movable with the piston in response to increased pressure build-up to trigger the actuation of a different fire suppressant medium; and some device to deactivate the heat source to allow the biasing member to return the piston to its normal state.

The primary object of this invention is an improved actuating device which allows a piston to automatically return to its normally cocked position.

DESCRIPTION OF THE PREFERRED EMBODIMENT

Figure 1:
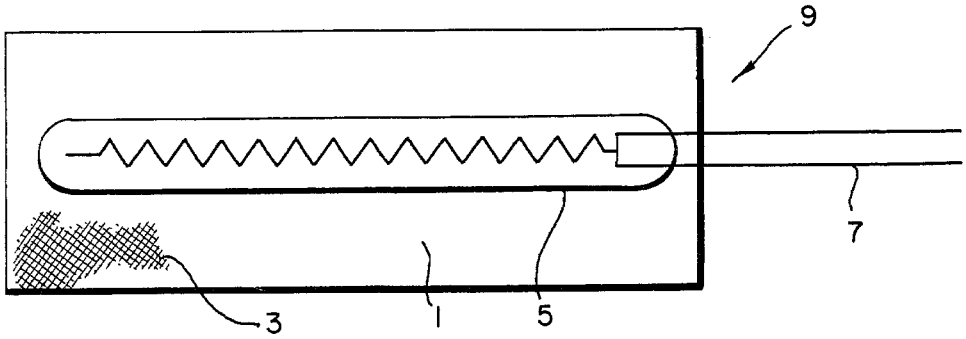
FIG. 1 illustrates the preferred embodiment of the metal hydride system used in this invention.
Figure 2:
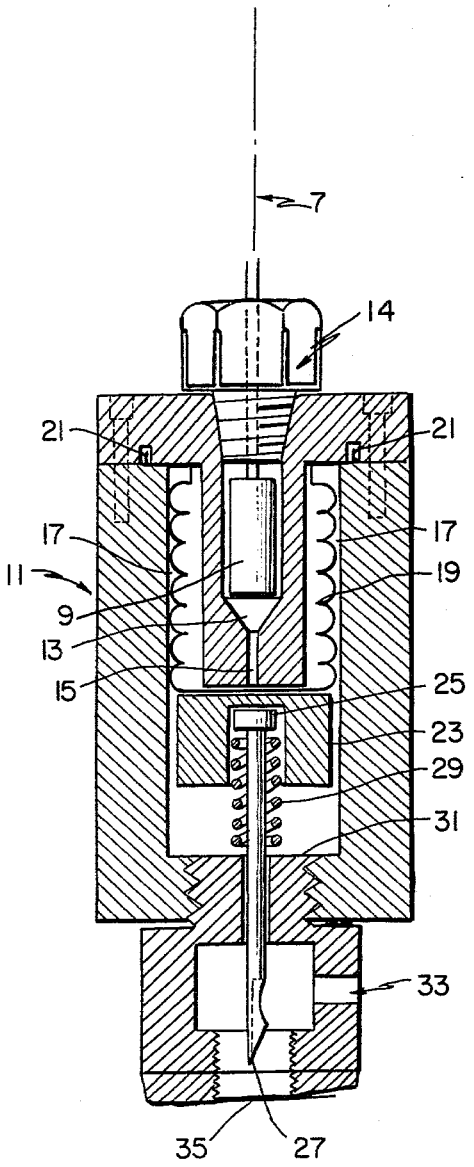
FIG. 2 depicts in cross-sectional view how the metal hydride system can operate with a puncture pin type of actuator.

The basic components making up the preferred embodiment for this invention are shown in FIGS. 1–2. A metal hydride powder 1 whose particles are initially about the size of sand is placed in a closed container 3 made from a very fine wire cloth. Also encased with the hydride is the electrical resistor element 5 used to heat the metal hydride via leads 7 to an external power source (not shown). Depending on the metal hydride selected, when sufficient heat is applied it gives off hydrogen gas. When the heat is removed, the release of hydrogen gas ceases. Thus, by turning the element 5 on-and-off the metal hydride is cycled through a sorbed and desorbed cycle. As this happens the powder tends to break up into smaller and smaller pieces until an average particle size of about $15\mu$ (microns or $10^{-4}$ cm) is eventually reached. By making the mesh hole size of the container 3 about $2\mu$, the hydride is confined to the container and the released hydrogen gas is allowed to escape therefrom. System 9 making up FIG. 1 is mounted in an actuator to allow this released hydrogen gas to perform a desired triggering function.

One metal hydride that has been used with the preferred embodiment is lanthium nickel ($LaNi_5$). When this is used, the typical hydride/hydrogen reaction is:

$$LaNi_5 + 3H_2 \rightleftharpoons LaNi_5H_6 + \text{Heat of Reaction.}$$

Of course, other metal hydrides selected for the specific needs and favorable characteristics needed can also be used. Two other hydrides which have been used are $CaNi_5$ (calcium-nickel alloy) and FeTi (iron-titanium).

In the cross-sectional view, FIG. 2, the metal hydride system 9 of FIG. 1 has been incorporated into the center section of the housing 11 forming the outer portion of the actuator. Actually, the hydride system is fixedly mounted in the chamber 13 which is closed at its upper end by a gland fitting 14 and opened at its lower narrower outlet 15. Within the actuator and surrounding the chamber 13 and concentric therewith is a second larger outer chamber 17 which contains the expandable metal bellows 19. This bellows is gas sealed to the housing at upper grooves 21 and encases the inner chamber containing the metal hydride on its other three sides. Immediately below the bellows and in physical contact therewith is the movable member 23 which moves in reciprocating piston type movement in the lower portion of chamber 17. In one less preferred embodiment, the bellows was replaced by a seal around the movable piston member between its outer surface and the walls of chamber 17. This same member 23 also serves as a bellows stop. A lower cut out section of this piston or stop member receives the upper enlarged head of the elongated puncture pin 25 which terminates at the lower sharpened point 27. A resetting spring 29 encircling the pin biases the piston type member to normally maintain it and the pin in the extended position shown. The pin extends through and its sharpened end terminates in the lower nitrogen cartridge assembly 31. This assembly forms still another chamber below the lower end chamber 17 and includes a diaphragm 35 forming part of a higher pressure nitrogen ($N_2$) gas cartridge (not shown) and an exit port 33 for this gas when the diaphragm is ruptured.

The operation of the actuator of FIG. 2 is straight forward. When the resistance element is supplied sufficient electricity it heats the metal hydride powder which if the proper temperature is attained causes hydrogen gas to be given off. This gas freely moves through the outer mesh of the assembly 9 and into the chamber 13. Since the chamber is sealed at all sides, except for the outlet 15, the gas exits therefrom to enter the surrounding bellows. With the continuous application of heat to the hydride, more and more hydrogen gas is liberated building up more and more gaseous pressure within the bellows. In a short time this pressure is great enough to cause the bellows to expand moving the contacting member 23 downward against the biasing action of its spring. The pin also moves downwardly until its sharpened end 27 cuts into the diaphragm 35 to release the $N_2$ gas. Upon release this gas generally exits under pressure through port 33 to actuate a pneumatic actuation fire protection system such as that illustrated in FIG. 4.

Figure 3:
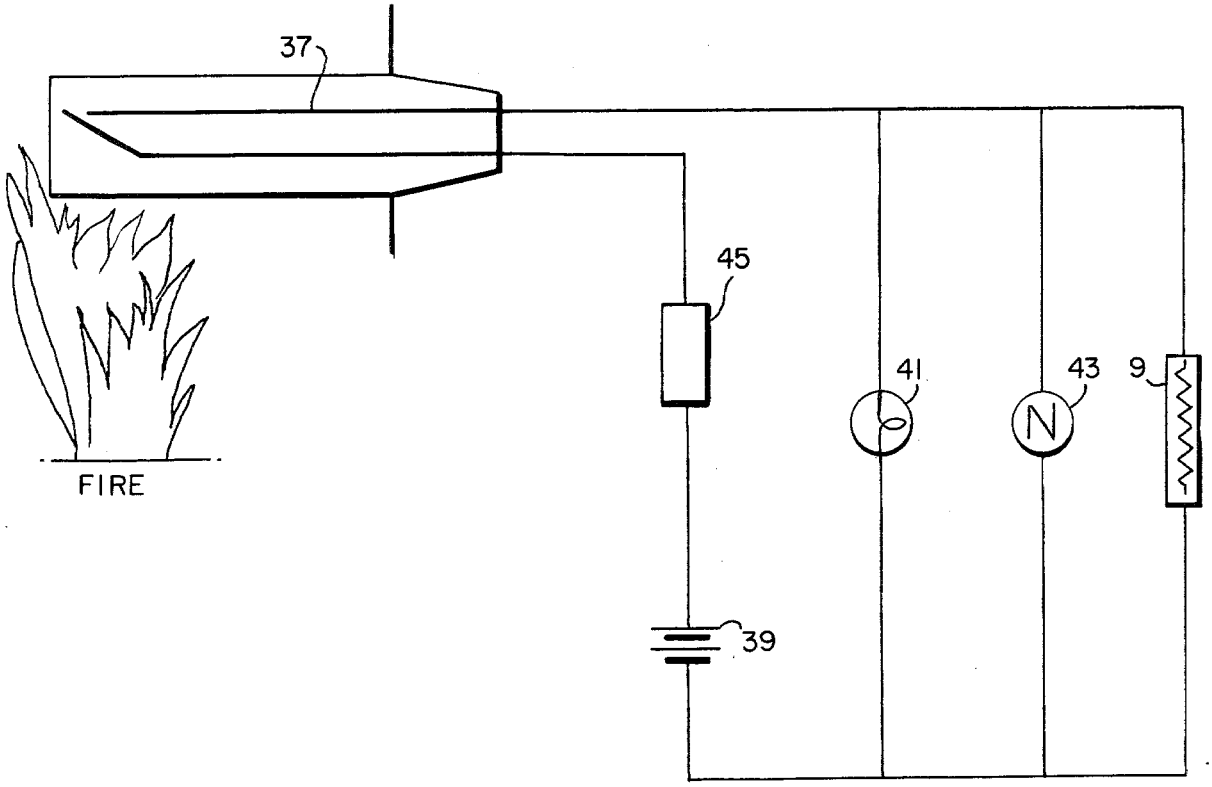
FIG. 3 is an electrical schematic diagram for a typical fire sensing system employing a metal hydride actuator.

FIG. 3 is a schematic of one type of electrical circuitry which can be used to actuate the metal hydride assembly 9. In this particular set up, a bi-metal strip 37 is exposed to the fire or explosion. Upon detecting sufficient thermal change the strip acts as a switch and closes its contact. Current supplied from battery 39 would then flow into the metal hydride system 9 to cause it to perform as described with respect to FIGS. 1–2. Indicators such as the warning light 41 and/or buzzer 43 may be connected in parallel with the metal hydride to tell an observer that the system has been activated. A lamp fuse 45 may also be used as shown to limit the current flow.

Figure 4:
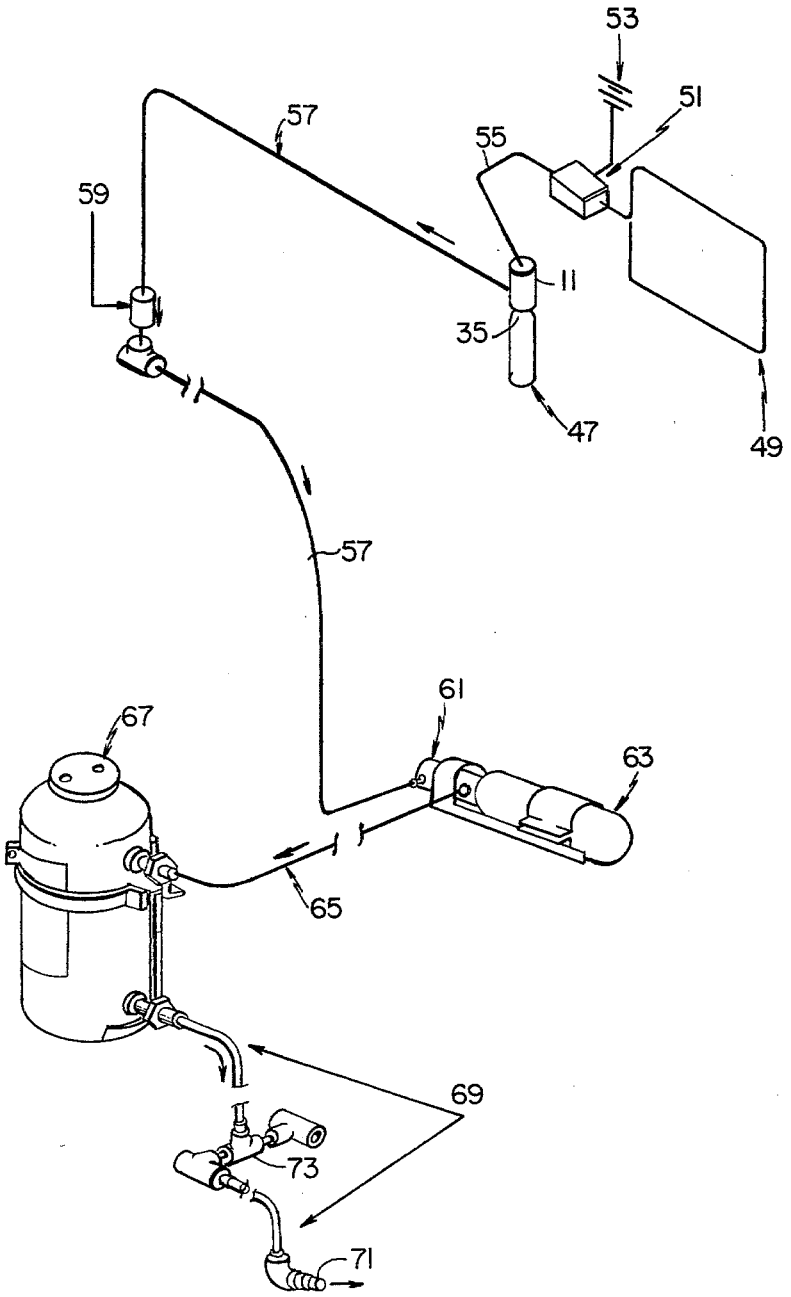
FIG. 4 shows a typical fire protection system employing this invention.

One possible complete fire protection system which can employ the preferred embodiment of the invention (FIGS. 1–2) is illustrated in FIG. 4. Essentially this example is a modified Ansul Co. (Marinette, Wisconsin 54143) automatic fire protection system which incorporates the FIG. 2 metal hydride actuator. With this system a puncture pin located in housing 11 is used, as described with respect to FIG. 2, to rupture a diaphragm 35 forming the upper surface for the high pressure $N_2$ (or $CO_2$) gas cartridge 47. Prior to this happening a detection cable 49 or spot sensor, similar in operation to the aforementioned bi-metal strip 37, has detected the change in thermal conditions and sent an electrical signal from control con- sole 51 via power source 53 and connector 55 to the actuator 11. Hydraulic hose line 57 with its standard swivel fittings and interposed check valve 59 feed the released gas to the pneumatic actuator 61. The latter actuator causes the very high pressure (about 1,800 psi.) gas cartridge 63 to release its gas via hose 65 and "fluidize" the dry powder contained in dry powder tank 67. It is this fluidized dry chemical powder that is the actual fire suppressant which is discharged via hose 69 from nozzle 71 on the fire. A manifold connection 73 allows several hoses and discharge nozzles—only one of which is shown—to be connected to the powder tank.

In one working embodiment of this invention (FIG. 2) designed to suppress a fire in a mine, the following parameters and conditions existed:

- ambient temperature 25° C.;
- metal hydride used was 2 grams $CaNi_5$;
- heat resistor used was a 56 ohm, 5 watt, Series 995 ohmite resister;
- actuator used was a PB-1 (Peter/Byron prototype #1, designed by myself and made by a coworker) prototype actuator;
- the piston diameter of member 23 was 1.875 inches with an area of 2.7612 square inches and a stroke of 0.35 inches with a total initial maximum volume of 0.7751 cubic inches;
- the spring constant for resetting spring 29 was 20 lbs./inch with a prestress force on the spring of approximately 10 pound of force;
- the level voltage of the power source applied to the resistor element 5 (FIG. 1) was 24 voltages;
- the actuator pressure at activation was 47.7 psia; and
- the measured time to actuate the piston was about 26.5 seconds.

The time for actuation of a little less than 30 seconds is not considered too long if the particular environment and use for which it is developed is considered. A fire protection system developed for use in a mine would be located on a mining machine and typically would incorporate a time delay between the sensing of the fire and the activation of the fire suppressant system. This delay is needed to allow the operator of the machine on which the system is mounted sufficient time to stop the machine and then leave the vehicle. Normally indicating devices such as the light 45 or buzzer 43 (see FIG. 3) will immediately alert the operator to the start of activation. Without this delay the cloud created by the discharging dry chemical fire suppressing powder could engulf the operator to severely limit both visibility and vehicle egress.

Besides the puncturing of the $N_2$ (or $CO_2$) high pressure cartridge as disclosed with respect to FIG. 2, other types of variations are possible. For example, plastic tubing pressurized by a high pressure $N_2$ gas can be strung around a high fire probability area with the tubing being used to hold back a piston and puncture pin capable of puncturing a $N_2$ gas cartridge. When a fire occurs, the tubing melts to release the piston and then, as in FIG. 2, the $N_2$ cartridge diaphragm is ruptured. Still another type of actuator has been developed by the Walter Kidde Corporation of 675 Main Street, Belleville, N.J. 07109. In that system a frangible link to keep a cable in tension that holds a spring compressed on top of a valve of a high pressure nitrogen gas tank is employed. When a fire takes place, the link is broken by the detonation of an explosive powder to release the spring and open the valve of the $N_2$ gas tank. The $N_2$ gas in turn would then release a dry powder fire suppressant.

There are thousands of metal hydrides available each one with its own unique pressure-temperature isotherm. Therefore, the particular hydride selected would be custon fit to meet the design constraints imposed. One way of doing this is to vary the alloy content of the hydride. For example, if the invention is used in connection with a fire or explosion protection system, a slow pressure build up at temperature below 121° C. (250° F.) would be desirable to reduce the effects of ambient heat from the weather, nearby equipment, etc. At temperatures above 121° C. the pressure from the released gases would rise rapidly. In the embodiment shown with an electrical resistance heating element for the heat source, temperatures on the order of 300° C. (572° F.) can quickly be reached. This higher temperature would be well above the required activation temperatures and the reaction of the hydride would be very rapid. The hydrides act sufficiently rapid to be considered as compressor and pumps limited only by heat transfer engineering. The publication entitled "HyStor Metal Hydrides" by the MPD Technology Corp. of Waldwick, N.J., on page 7, paragraph 4, describes more details relating to hydrides. The Society of Automotive Engineers (SAE) publication 760569 entitled "Metal Hydride Storage for Mobile and Stationary Applications" derived from their St. Louis, Mo., meeting of June 7–10, 1976 on Fuels and Lubricants; discloses many details relating to hydrides and in particular iron-titanium hydride (Fe Ti $H_2$), used to store hydrogen gas in the Fe Ti metal. This same metal hydride could be used in the disclosed embodiment shown. The essential attributes that this invention seeks from the use of metal hydrides reside in their ability to absorb or store large amounts of hydrogen in very small volumes and to release the stored hydrogen upon the application of heat to create a sufficient pressure build-up to move the piston. Also the metal hydride must, upon cooling, be able to again re-occlude or store the hydrogen released. The exact parameters needed to accomplish a specific task would, of course, vary depending on such these as: the size of the piston involved; the temperature between which it operates to release and absorb the gas; the heat source temperature and ambient temperatures; the volumes involved; and other determinative parameters such as the forces associated in activation; the energy available for activation; the time required for activation and recocking; the particular considerations in the actuator assembly (i.e., any special requirement associated with the hydride used); pressures associated in activated and nonactivated states; and heat transfer characteristics of the various parts of the actuator (i.e., (1) resistor to hydride, (2) hydride to actuator, and (3) actuator to ambient surroundings). Known research shows many hydrides can absorb hydrogen at densities greater than twice that of liquid hydrogen and that there is no evidence of hydride degradation upon cycling. Assuming no leakage in the system, the lack of degradation may allow the piston to almost return indefinitely to its initial position upon cooling.

Other uses and variations to the disclosed features of the preferred embodiment are clearly possible. For example, the metal hydride could conceivably be designed so that the temperature at which the hydrogen gas is released coincides with the range of possible temperatures for explosions or fires. In this way, even if the electric system for the heat source becomes damaged or otherwise inoperative, the fire or explosion itself could possibly activate the invention. Other uses for this invention include: the activation of a heat safety switch for furnaces, motors, engine compartments, etc., the resetting of a valve actuator or solar heating panels to control hot water flow, home or business thermostat controls, etc. It should be clear that the pin need not always break a diaphragm to release a stored gas. It could just as easily trip an electric switch or serve to trigger or activate almost any other type of operation.

The simplicity, reliability, ruggedness, recocking capability, safety, and inexpensiveness should be apparent from the foregoing disclosure. It is simple because it has only one moving part (metal bellows) to wear out. It is reliable or fail-safe because there is little to go wrong mechanically and because it depends only on the addition of heat, from whatever source, for its activation. By properly constructing the housing and other parts the invention can be made very rugged to withstand the hostile conditions of a mine or other harsh environment where there are extremes of temperature changes, moisture variations, harsh chemicals, radiation, or violent vibrations. It can rearm itself without the use of special tools or attendant operator safety problems associated with such. Currently metal hydrides are comparably inexpensive (for example, iron titanium hydride is about $20 per kilogram) and the actual amount of hydride used is extremely small—about 1 to 2 grams in the disclosed embodiment.

None of the discussed features of the preferred exemplary embodiment or of the possible variations thereto should be used to limit the scope and extent of this invention which is to be measured only by the claims which follow.

I claim:

1. A metal hydride actuation device comprising:

a container having a metal hydride material located therein, said container being constructed to act as a storage medium for the material and capable of allowing any released gases therefrom to freely pass through the container's walls;

means to supply heat to the metal hydride in its container;

a first chamber substantially surrounding the container on all sides and having an expandable volume under the influence of gaseous pressure;

a second chamber substantially surrounding the first chamber and formed by a housing containing a member capable of reciprocal movement;

biasing means in the second chamber to normally maintain the reciprocating member against the first chamber; and means for actuating the discharge of a triggering medium whereby upon the application of heat to the metal hydride hydrogen gas is liberated from the container to build up a gaseous pressure in the first chamber until the pressure is sufficient to move the reciprocating member from its normal position against the biasing member and thereby cause the means for actuating to trigger the medium.

2. The device of claim 1 wherein the means to supply heat to the metal hydride is an electrical resistor powered from an external source.

3. The device of claim 1 wherein the container for the metal hydride material is made of a finely meshed material whose hole size openings are considerably less than the average particle size diameter of the material forming the metal hydride.

4. The device of claim 1 wherein the container is mounted in a third chamber closed on all sides except for at least one exit opening, said third chamber being located substantially within the first chamber so that any gaseous discharge from the third chamber will enter into the first chamber.

5. The device of claim 4 wherein the first chamber is a flexible bellows whose lower outer surface contacts the top of the reciprocatable member.

6. The device of claim 1 wherein the member capable of reciprocal movement is a piston which moves in the second chamber, said biasing member being a coil spring operatively associated with the piston and said means for actuating a discharge being a puncture pin rod encircled by said spring along at least part of its length.

7. The device of claim 1 also comprising in combination:

a reservoir containing a pressurized gas as the triggering medium which is actuated by the means for actuating;

said pressurized gas being used to actuate the discharge of a fire suppressant powder material.

8. The device of claim 1 wherein the metal hydride material used in a powder comprising a calcium nickel alloy hydride.

9. The device of claim 1 also including a heat sensing device connected to said means to supply heat to the hydride and operating as a control for its operation.

10. The device of claim 9 wherein said sensing device comprises a bi-metal material which is activated by ambient thermal conditions.

* * * * *